US005322706A

United States Patent [19]

Merkel et al.

[11] Patent Number: 5,322,706

[45] Date of Patent: Jun. 21, 1994

[54] METHOD OF MONITORING PARAMETERS OF COATING MATERIAL DISPENSING SYSTEMS AND PROCESSES BY ANALYSIS OF SWIRL PATTERN DYNAMICS

[76] Inventors: Stephen L. Merkel, 380 Oakmoor, Bay Village, Ohio 44140; Scott R. Miller, 10845 Shagbark Trail, Roswell, Ga. 30075; Kevin C. Becker, 23147 Hilliard Blvd., Westlake, Ohio 44145

[21] Appl. No.: 980,422

[22] Filed: Nov. 23, 1992

Related U.S. Application Data

[63] Continuation of Ser. No. 600,319, Oct. 19, 1990, abandoned.

[51] Int. Cl.[5] ..... B05D 1/02

[52] U.S. Cl. ..... 427/8; 427/10; 427/421; 239/71

[58] Field of Search ..... 427/8, 10, 422, 421; 239/67, 71

[56] References Cited

U.S. PATENT DOCUMENTS

| | | | |
|---|---|---|---|
| 3,316,410 | 4/1967 | Meili et al. | 250/218 |
| 3,587,079 | 6/1971 | Obergefell et al. | 340/270 |
| 4,453,652 | 6/1984 | Merkel et al. | 222/504 |
| 4,629,903 | 12/1986 | Giacobbe et al. | 250/273 |
| 4,668,948 | 5/1987 | Merkel | 239/71 |
| 4,785,976 | 11/1988 | Bennie et al. | 222/370 |
| 4,785,996 | 11/1988 | Ziecker et al. | 239/135 |
| 4,842,162 | 6/1989 | Merkel | 239/69 |
| 4,905,897 | 3/1990 | Rogers et al. | 239/298 |
| 4,963,757 | 10/1990 | Liefde et al. | 250/571 |
| 5,208,064 | 5/1993 | Becker et al. | 427/8 |

FOREIGN PATENT DOCUMENTS

| | | | |
|---|---|---|---|
| 11917 | 11/1989 | European Pat. Off. | B05B 12/08 |
| 3817096 | 8/1988 | Fed. Rep. of Germany | G01N 21/88 |
| 1-224065 | 9/1989 | Japan . | |

OTHER PUBLICATIONS

Nordson Corporation 1987 Annual Report.

*Primary Examiner*—Shrive Beck
*Assistant Examiner*—Benjamin L. Utech

[57] ABSTRACT

A method of monitoring and/or controlling the motion of a moving coating material dispensing pattern or fiber is provided with a monitor that senses a medium such as sound, light or other form of energy near the space between the dispensing device nozzle and a substrate, and a monitoring signal is generated. Information relating to the pattern motion is extracted, and an output signal is generated representative of characteristics of the motion of the pattern in the space. One or more transducers are used to extract the information, which is analyzed, preferably by comparison of a frequency spectrum of the signal with a spectrum of standard signal, to detect deviations in the system operation from desired criteria. Optionally, the output signal is used to control parameters of the system. In another embodiment, plural spaced transducers detect the phase or orientation of the moving pattern and remove background noise, by inverting, summing, multiplying, and otherwise combining the signals. The invention is useful for detecting malfunctions of the system components, for real-time closed loop control of the process, and for quality control inspection of dispensing device components during manufacture.

31 Claims, 3 Drawing Sheets

METHOD OF MONITORING PARAMETERS OF COATING MATERIAL DISPENSING SYSTEMS AND PROCESSES BY ANALYSIS OF SWIRL PATTERN DYNAMICS

This application is a continuation of application Ser. No. 07/600,319, filed Oct. 19, 1990 now abandoned.

The present invention relates to the dispensing of coating materials, such as adhesives, and, more particularly, to the monitoring of the processes and apparatus by which coating materials are dispensed through space in moving paths or patterns such as, for example, a rotating swirl pattern assumed by a dispensed pressure adhesive in a controlled fiberization system.

BACKGROUND OF THE INVENTION

Controlled fiberization is a process for the application onto substrates of coating materials, such as pressure sensitive adhesives. The process was developed from air-assisted and melt-blown technologies. It provides a method of applying a continuous fiber of adhesive on a substrate surface in a dense distribution of precise width, fine edge definition, and specific fiber thickness, and achieving a controlled uniform density of the adhesive material on the product.

With controlled fiberization, a high viscosity material such as adhesive is dispensed in a continuous flowable stream or fiber, usually in the form of a swirling three dimensional spiral pattern extending from a dispensing nozzle onto a substrate. The swirling movement of the pattern is a result of the ejection of the high viscosity material under pressure from a nozzle to form a continuous adhesive fiber, then directing streams of air onto the fiber from a circular array of skewed air jets spaced around the nozzle to propel and swirl the material into a rotating pattern which moves toward the substrate. The air streams, together with the forward momentum and centrifugal force of the ejected material, force the material into a rotating outwardly spiraling helical pattern in which its own cohesive and elastic properties hold it in a string-like or rope-like strand.

Controlled fiberization methods for the application of pressure sensitive adhesives and the devices using such methods are described, for example, in U.S. Pat. No. 4,785,996 entitled ADHESIVE SPRAY GUN AND NOZZLE ATTACHMENT assigned to Nordson Corporation, Amherst, Ohio, the assignee of the present invention, and hereby expressly incorporated herein by reference.

The use of controlled fiberization techniques requires, for the above described advantages to be realized and the industry demands to be met, proper control of the application process and proper functioning of the dispensing apparatus. Absent accurate control of the system parameters and proper function of the dispensing device, some or all the above advantages are lost, including particularly those affecting the quality of the products and the cost and efficiency of the dispensing operation.

Accordingly, there is a need to provide coating material dispensing systems and processes, particularly controlled fiberization dispensing systems and processes for the application of adhesives, as for example pressure sensitive adhesives, and to provide the dispensing operation with monitoring capabilities that can accurately, quickly and economically determine the performance of the system components and of the adhesive application process.

SUMMARY OF THE INVENTION

An objective of the present invention is to provide a method and apparatus for determining the performance of processes for the dispensing of coating material in moving patterns such as occur in a controlled fiberization dispensing system. More particular objectives of the present invention are to provide for monitoring the conditions of the system components, for monitoring or controlling operating parameters of the dispensing process, and for controlling the quality of the dispensing nozzle or other components of the dispensing devices. A further objective of the present invention is to maintain the swirl pattern created by the dispensing of coating material onto a product in a controlled fiberization system in a predetermined manner.

According to the principles of the present invention, the motion or change in the position or shape of a pattern of the flowing dispensed material in the space between a dispensing device and a substrate onto which the material is deposited is monitored. The monitoring is achieved by sensing an information carrier, such as sound or other form of energy, which carries information of the movement of the pattern of the dispensed material in the space. The information carrier is preferably sound energy influenced in part by the movement of the pattern of dispensed material, but may be light or some other carrier or medium generated, modulated or otherwise characterized by information of the motion of the pattern in the space. Information pertaining to the pattern movement is extracted from the sensed energy or medium for analysis, and signals corresponding to the movement the pattern are produced.

From the extracted information, the effects of changes in parameters such as pressures and temperatures can be detected, and failures of the system, such as a clogged air jet or nozzle, can be immediately determined. In one application of the invention, signals are analyzed for the purpose of determining the performance of the dispensing device components so defects in the manufacture of system components can be quickly identified. In another application of the invention, signals are analyzed for the purpose of detecting deviations from optimal system operation, and adjustments are made, either by manual servicing of the equipment or through closed loop feedback control. In a further application of the invention, closed loop control of system parameters, such as adhesive nozzle or air jet pressure, for example, maintains a desired coating distribution on the substrate as other parameters such as line speed change.

In a preferred embodiment of the invention, signals received from sensors near the moving pattern are analyzed to extract information, such as frequency, amplitude and the harmonics present in the signals. From the extracted information, pattern characteristics such as swirl frequency, and amplitude or radius of the propagating pattern can be determined. Such information is extracted, for example, in the form of a frequency spectrum of the signal. The monitored characteristics of the pattern are correlated with predetermined criteria, such as signals from similar measurements taken under desired conditions for reference and comparison. Deviations detected in monitored data are used during the operation to detect changes in the characteristics for determination of the causes of the changes.

In another preferred embodiment of the present invention, a plurality of transducers is provided, each in a different spaced relationship with the swirl pattern being monitored. The transducers, so arranged, provide the capability of extracting information that relates to the phase or angular position of the swirl pattern, and for enhancing the signal-to-noise ratio by, for example, recognizing and cancelling the background noise.

In certain embodiments, such as where the medium is sound, plural microphones are spaced at fixed angular positions around the swirl pattern. Preferably, the transducers are employed in diametrically opposed pairs, spaced 180° around the center of the pattern. When the rotating pattern brings the fiber toward one transducer the fiber moves away from the other, resulting in the signals from the pattern motion being 180° out of phase. The transducers of the pairs are preferably spaced close with respect to the wavelength of background noise so that both transducers of the pairs receive the noise in phase. Where the swirl frequency is in the range of from 400 Hz to 3.5 kHz, such spacing would be preferably approximately one inch. The microphones are preferably omnidirectional or otherwise balanced to enable each to represent noise from the same source with signals of equal intensity. The signal from one transducer of a pair is then inverted and the two signals from the pair of transducers are summed, thereby cancelling the common noise components of the signals while enhancing the signal component originating from the motion of the pattern.

Where the medium is sound, it is preferable that the microphones be spaced close to the nozzle and preferably just behind the plane of the nozzle and out of the path of the air from the jets. So positioned, the signal received is found to be stronger, for sound at least, than with microphones positioned farther from the nozzle.

The following definitions are applicable to this specification, including the claims, wherein:

"Horizontal plane" is a plane which is perpendicular to the centerline of the conical swirl pattern of the fiber.

A "plane of the nozzle" is a plane which intersects the nozzle.

"Horizontal plane of the nozzle" is a horizontal plane which intersects the nozzle.

With a pair of microphones, it is also preferred to utilize the summing of the signals in conjunction with the product of the signals, preferably by using the algebraic sign of the product of the signals, to discriminate between signal and noise. For example, a frequency shift in the sum of the signals may be indicative of either noise or a system abnormality. If one signal is inverted with respect to the other and the two signals are multiplied, a positive product coupled with the occurrence of a frequency shift may be, for example, an indication of a system abnormality. On the other hand, a negative product may indicate that the frequency shift is one due to noise.

The present invention provides the ability to extract information of the performance of a swirl adhesive dispensing system and operation without the need to modify or physically connect to the system components. Thus, the system is not affected by the measurement process. Furthermore, the need to place transducers physically in the system, and the complexity and expense are reduced.

The multiple transducer feature provides not only the ability to resolve the signal produced by the moving pattern against the background noise of a factory, but the ability to detect the phase of the rotating pattern. It is also believed to yield information relating to the direction of any eccentricity of the pattern, its instantaneous angular orientation, its direction of rotation, and other phase dependent characteristics.

These and other objectives and advantages of the present invention will be more readily apparent from the following detailed description of the drawings in which:

DESCRIPTION OF THE DRAWINGS

Figure 1:
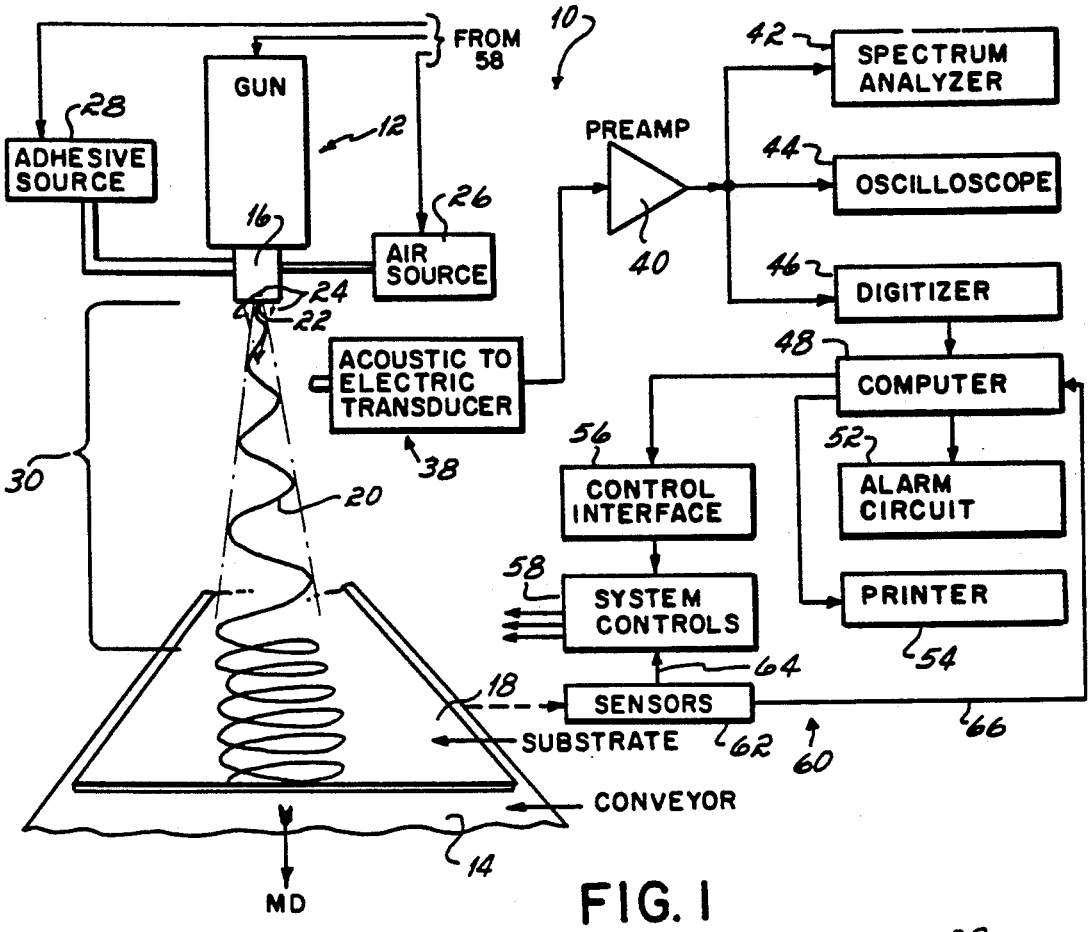
FIG. 1 is a perspective diagram of a controlled fiberization adhesive dispensing system embodying principles of the present invention illustrating one embodiment thereof.

Referring to FIG. 1, a portion of a controlled fiberization adhesive dispensing system 10 is illustrated. The system 10 preferably includes a controlled fiberization adhesive swirl spray gun and nozzle 12 of one type manufactured and sold by Nordson Corporation, Amherst, Ohio. In the application described herein, the gun is a Nordson® Model H200-J or Model CF-200 controlled fiberization gun and nozzle. U.S. Pat. No. 4,785,996, incorporated herein by reference, describes such guns in detail. The gun 12 has a nozzle 16 which may be, for example positioned above the conveyor 14 and oriented toward the surface of the substrate 18 that is the object onto which the adhesive is to be deposited.

In a controlled fiberization system 10, adhesive in the form of a continuous fiber 20 is ejected from a central opening 22 in the nozzle 16 and propelled by a current of air from a symmetric and circular array of jets 24 surrounding the nozzle opening 22. A source of pressurized shop air 26 supplies the air to the gun 12. The adhesive may be a pressure-sensitive adhesive supplied as a hot-melt from an adhesive source 28 with, for example, a gear pump driven hot-melt applicator. Such adhesive may be, for example, adhesive No. 2881 manufactured by National Starch and Chemical Company.

The current of air causes the fiber 20 to assume a continuous spiral shape that is generally conical in a region 30 between the nozzle 16 and the substrate 18. The shape of the fiber 20 in the region 30 is dynamic and resembles that of a twirling rope, although the adhesive is constantly moving away from the nozzle 16 toward the substrate 18.

The dynamics of the swirl pattern are believed to be such that, when the system 10 is dispensing adhesive properly, the intersection of the pattern with a stationery horizontal plane between the nozzle and the substrate generally will move at approximately constant velocity in approximately a circle. This produces audio frequency pressure waves, or sound, which can be detected. In addition, the fiber 20 produces audio frequency pressure waves as it passes through the ring of air streams emanating from the array of jets 24, which impart to the fiber 20 angular momentum, which causes the fiber 20 to tend to move in the circle. As a result of these factors, sound has been found to be produced having a fundamental frequency in one example of from 1000 to 1500 Hz when the system was operating properly.

According to one embodiment of the present invention, a microphone or other acoustic to electrical transducer 38 is positioned near the space surrounding the region 30 adjacent the swirl pattern of the fiber 20 and preferably in the vicinity of the nozzle, including behind and forward of the plane of the nozzle. The microphone 38 is preferably directional so as to eliminate background noise from other than the direction of the swirling fiber 20. The output of the microphone 38 may be connected through a preamplifier 40 to a spectrum analyzer 42, an oscilloscope 44, and through a digitizer 46 to a special, or preferably general, purpose computer 48. The computer 48 also may have outputs connected to an alarm circuit 52, a printer 54, and through a control interface 56 to the controls 58 of the system 10. The controls 58 have outputs represented in FIG. 1 as, for example, outputs connected to inputs of the material dispensing gun 12 to control the dispensing of the fluid, to the air source 26 to control, for example, the pressure of the air at the air jets 24 of the nozzle 16, or to the adhesive source 28 to control, for example, the flow or pressure of the adhesive at the orifice 22 of the nozzle 16, or to other control inputs of the system 10.

In certain embodiments of the invention, closed loop feedback or programmed control, which is responsive to the monitored characteristics of the swirl pattern sensed by the transducer 38, are compared by the computer 48 with stored desired characteristics of the sensed pattern characteristic, or is processed according to some programmed response function. Then, in response to the processing by the computer 48 of the signal from the transducer 38, control signals on the output lines from the system controls 58 control such system parameters as the air pressure supplied by the source 26 at the jets 24, the pressure of the adhesive from the source 28 at the orifice 22, the on/off condition or other operating parameter of the gun 12, the speed of the conveyor 14, the temperature of the air or adhesive at various points of the system 10, or some other parameter or control of the system. Such feedback control may include additional sensors 62, which may monitor additional information from the system 10 and communicate the information, for example, to the system controls 58 through line 64 or to the computer 40 through line 66.

The microphone 38, preamplifier 40, analyzer 42, oscilloscope 44, digitizer 46, computer 48, alarm 52 and printer 54 of FIG. 1 represent only some of many forms and components of a monitoring system 60, which may be used to monitor the dynamics of the pattern of the fiber 20.

Figure 1A:
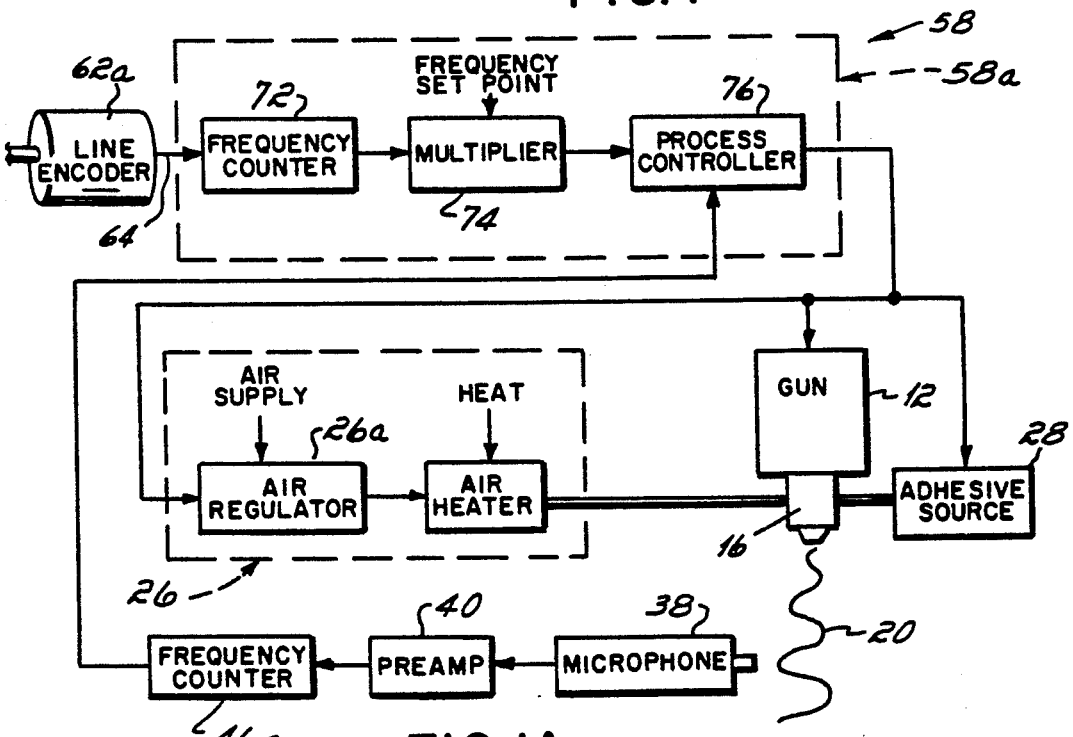
FIG. 1A is a block diagram of one embodiment of a portion of the diagram of FIG. 1.

FIG. 1A, for example, illustrates one preferred version of a control feature wherein the sensor 62 of FIG. 1 comprises a line speed encoder **62*a*, which produces a pulse stream on line 64 to the system controls 58. The system controls 58 include a line speed compensation control 58*a* that includes a frequency counter 72, which digitizes the line speed signal, a swirl frequency setting adjustment 74, which accepts a frequency set point and multiplies it to vary it with the speed of the conveyor, and a process controller 76. The process controller 76 combines the line speed signal from the multiplier 74 with a signal from the microphone 38, amplified by the preamplifier 40 and digitized by the frequency counter 46*a*. The process controller 76 may, in this embodiment include, in addition to the functions of the system controls 58, certain logic functions of the control interface 56 and computer 48 of the embodiment of FIG. 1. The signal output from the control 58*a* is used to vary the control signal to the air regulator 26*a* of the air source 26, and to the adhesive source 28 and the gun 12**, to control air and adhesive pressure so as to maintain, with closed loop control, a spray pattern of controlled width and fiber thickness, and of constant adhesive distribution density on the substrate, as the line speed varies. This feature is particularly useful to produce quality product when running the line speed up to operating speed, slowing the line down during adjustments, and during other situations where it is desirable to produce acceptable product while the line speed differs from the intended operating speed for whatever reason.

Figure 2:
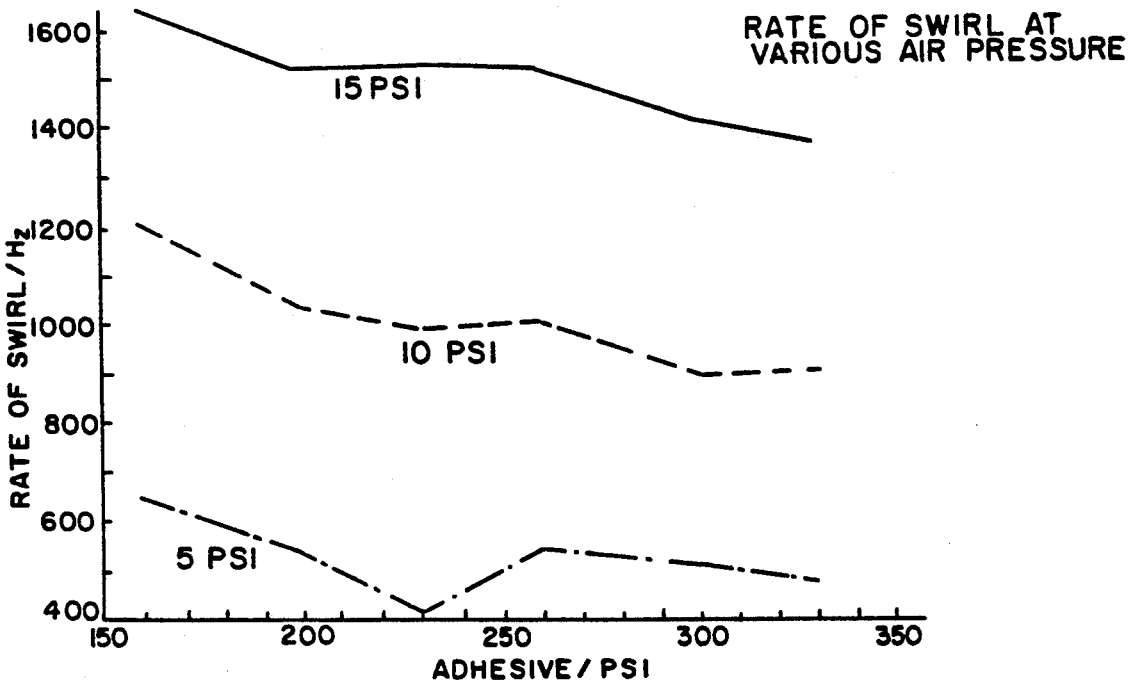
FIG. 2 is a graph showing the fiber swirl rate or frequency of the system of FIG. 1 at various air pressures as a function of adhesive pressure.
Figure 3:
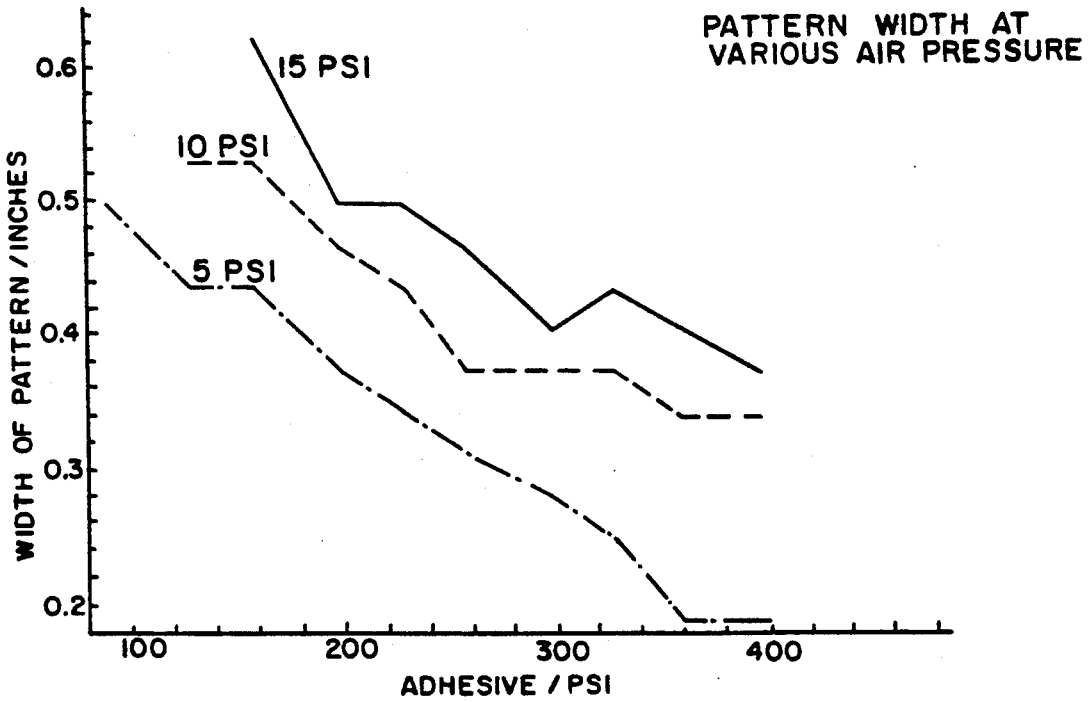
FIG. 3 is a graph showing the fiber pattern width of the system of FIG. 1 at various air pressures as a function of adhesive pressure.

It has been found that changes in various characteristics of the signal due to changes in the shape and motion of the pattern of the fiber 20 occur when parameters or operating conditions of the system 10 vary. For example, changes in the pressure or dispensing rate of the adhesive from the orifice 22 and changes in the pressure of the air from the holes 24 result in a change in the monitoring signal characteristics. FIGS. 2 and 3 show how changes in the swirl frequency and the swirl width can result from changes in adhesive and air pressure, respectively in accordance with the embodiment of the system of the invention described above. Such changes in the swirl pattern are, it has been found, reflected in changes in the frequency and amplitude of the monitoring signal. Thus, the monitoring of the dynamics of the swirl pattern according to the present invention yields information by which changes in the operating parameters of the system 10, such as changes in adhesive or air pressure, can be detected.

Deviations from ideal operating conditions have been determined to cause detectable changes in the characteristics of the monitoring signal. For example, the blockage of one or more of the air jets of the nozzle affect the swirl frequency and amplitude and the stability of the pattern, which will tend to exhibit a wobble. Such changes in the pattern cause generally a decrease in the base swirl frequency and amplitude and an increase in the number and amplitude of harmonics in the monitoring signal. Accordingly, the monitoring of the swirl pattern dynamics according to the present invention yields information by which the blockage of air jets of the nozzle can be detected.

A monitoring system 60 will develop a generally sinusoidal signal having a base frequency approximately equal to the swirl rate of the fiber 20, as for example 1500 hertz, and will be of a fairly predictable waveform when the system is operating properly. This signal will have a certain amplitude, which also will be at a level that is predictable for a particular system 10 and monitoring system 60. In such a signal, one or two harmonics will usually be detectable.

In the illustrated embodiment of the monitoring system 60, characteristics of the monitoring signal received from the transducer 38 can be extracted from the signal by conventional analytical techniques to the communications and monitoring arts. For example, spectrum analysis and Fourier transformation of the signal with the analyzer 42 will identify the frequencies of the base mode of the signal and of harmonics, and will determine the relative amplitudes of the various frequency components that make up the signal. The oscilloscope 44 will provide a visual manner for interpretation of the signal by a human operator or to be photographed for more rigorous analysis. The digital computer 48 may provide for the automated analysis of the signal.

Figure 4:
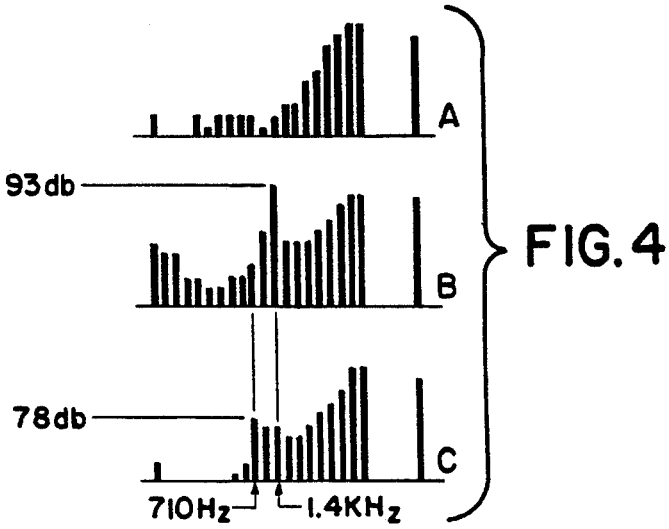
FIG. 4 is a graph of a swirl pattern monitoring signal generated in accordance with one preferred embodiment of the present invention.

FIG. 4 shows several graphs of frequency spectrum output of audio signals from a monitoring operation done in accordance with the embodiment of the system of the invention described above. In FIG. 4, graph A shows an audio frequency spectrum of the acoustic output of the microphone, digitally processed by the computer, and plotted in one-half octave increments of frequency from 31.5 Hz to 22.4 kHz, for the specific system described above with only air at 10 psi applied to the nozzle. Graph B shows the same plot with the addition of 190 psi of adhesive applied to the nozzle, adding a peak at 1.4 kHz having a magnitude of, for example, 93 db. In graphs A and B, the orifice 22 and jets 24 are in their normal unobstructed condition.

When one of the air jets of the nozzle is blocked, however, the frequency spectrum of the sound received by the microphone is that shown in graph C of FIG. 4, with the peak frequency shifted down one octave, to 710 Hz, and at a level of 78 db.

Similar tests at, for example, adhesive pressure of 140 psi with air pressure at 10 psi produced a fundamental frequency of 1.01 kHz with a second harmonic 24 db below the fundamental frequency peak. With one air hole blocked, and with the same system set at the same parameters, the fundamental frequency dropped to 500 Hz with the second harmonic only 15 db below the peak, but with a third harmonic apparent at 25 db below the peak frequency amplitude. Then with two adjacent air holes blocked, the frequency of the first or fundamental frequency dropped to 400 Hz with second through fourth harmonics appearing at amplitudes below the peak or first harmonic amplitude of 10 db, 18 db and 25 db, respectively. Furthermore, with two air jets blocked, but opposite the nozzle rather than adjacent each other, the shape of the waveform in the time domain changed. Such deviations in the sound signal from that produced by a normal operating system are quickly detectable with the present invention, either by automated techniques or by human operator observation of the output of the monitoring system.

The swirling pattern of the fiber 20 will generate, in addition to a sound wave, signals in other forms of energy such as light or electromagnetic radiation. For example, light, particularly the monochromatic coherent light from a laser, or electromagnetic radiation such as microwave radiation, when directed into the area occupied by the swirling fiber pattern, will be modulated with information of the motion of the fiber. Such signals can be received and the information of the pattern motion extracted from the signals for analysis in accordance with the present invention.

The selection of the form of energy to be detected and the overall system design will depend on the application and the noise levels of the various energy forms, which are present in the environment of the system. In some applications, for example, audio noise from the production process may adversely affect the quality of the information that a sound detection system will yield. Thus, in such an application, either audio noise reduction techniques must be employed with a sound detection system or another system, such as a light or microwave system may be employed. One such system illustrating a means for reducing ambient noise is illustrated below.

Figure 5:
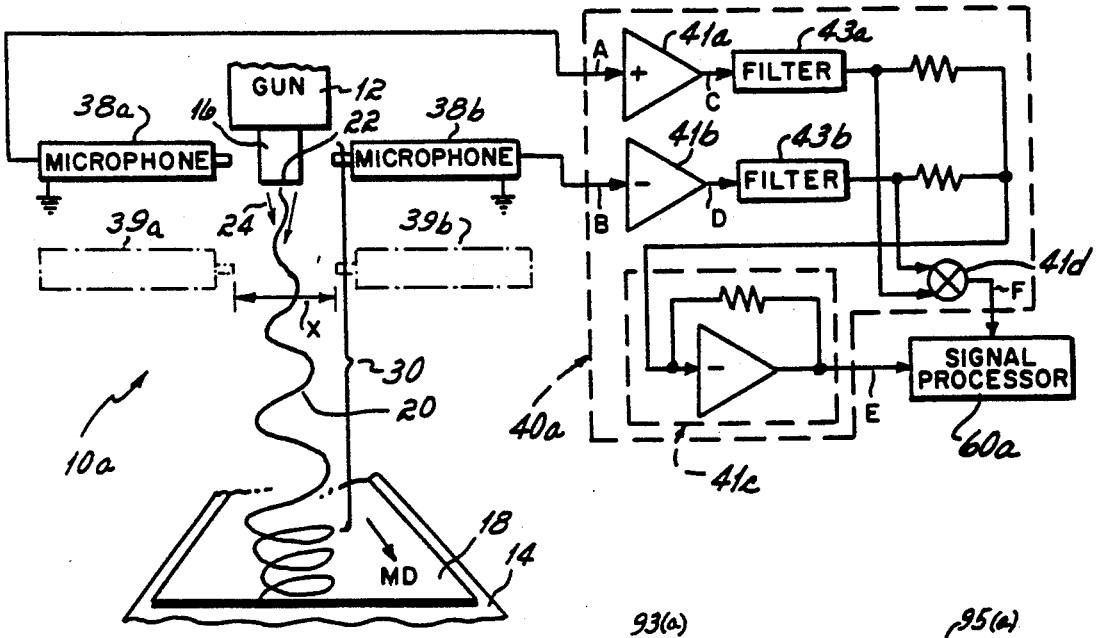
FIG. 5 is a perspective diagram of a controlled fiberization adhesive dispensing system of FIG. 1 illustrating an alternative embodiment thereof.

Referring to FIG. 5, a portion of the preferred embodiment of a controlled fiberization adhesive dispensing system **10*a* is illustrated. As with the system 10 of the embodiment of FIG. 1, the system 10*a* includes the spray gun and nozzle 12, positioned adjacent the product conveyor 14, with the nozzle 16 oriented towards the surface of the substrate 18 onto which the adhesive is to be deposited. The fiber 20 is ejected from the central opening 22 in the nozzle 16 and propelled by a current of air from a symmetric and circular array of jets 24 surrounding the nozzle opening 22. The current of air causes the fiber 20 to assume the continuous helical shape. According to this preferred embodiment, two microphones or other acoustic to electrical transducers 38*a* and 38*b* are employed for detecting the swirl noise. The outputs of the microphones 38*a* and 38*b* are connected through a conditioning circuit 40*a* to a signal processor portion 60*a* of a monitoring system such as for example the system 60 of FIG. 1**.

The transducers **38*a* and 38*b* are preferably positioned directly opposite the centerline of the pattern of fiber 20 and face each other in a horizontal plane that intersects the pattern. As such, their proximities to the pattern at its point of intersection of this horizontal plane, and the acoustic signals received by the microphones 38*a* and 38*b* are 180° out of phase. In this embodiment, the microphones 38*a* and 38*b*** are preferably omnidirectional, or at least bi-directional, such that each receives a detectable level of the noise received by the other, so the signals can be correlated and the noise components cancelled.

While the microphones **38*a* and 38*b* can be located near the space adjacent the swirl pattern of the fiber 20, it is preferred to locate them in the vicinity of the nozzle opening, including behind and forward of the plane of the nozzle, but out of the path of the air from the jets. In those systems wherein the nozzle 16 extends from the spray gun 12, in other words the nozzle is not recessed, it has been found that it is more preferable to locate the microphones 38*a* and 38*b* in a region extending from the nozzle opening to a point behind the plane of the nozzle. Utilizing the gun and nozzle as set forth in FIG. 1**, it has been found that the most preferred position was located at a horizontal plane which bisected the nut of the nozzle.

While it is preferred that the microphones face one another, the angular inclination with respect to the centerline of the swirl is not believed to be critical as long as the diaphragm of the microphone is small with respect to the wavelengths of the sound to be measured. In other words, both microphones may be oriented at about 90° with respect to the centerline of the swirl or they both could be oriented at an acute angle with respect to the horizontal as illustrated in phantom in FIG. 5.

In the embodiments of FIG. 5, the outputs from both the transducers are fed to inputs of the conditioning circuit 40*a*. The output of the first microphone 38*a* is connected to the input of an inverting amplifier 41*a* within the conditioning circuit 40*a*, while the output of the microphone 38*b* is connected to an input of a non-inverting amplifier 41*b* of the conditioning circuit 40*a*. The non-inverting amplifier 41*b* may be similar to the preamplifier 40 of FIG. 1. The outputs of the amplifiers 41*a* and 41*b* are connected each through a 500 Hz to 3.0 or 3.5 kHz band pass filter 43*a* and 43*b* respectively to inputs of a summing amplifier 41*c* where the two output signals, which are virtually identical, are added. The additive signals, being out of phase originally before one was inverted represents the signals received from the swirl, reinforce each other, while the noise portions of the signals that were identical and generally in phase before one was inverted, are subtracted from one another leaving only the additive signal associated with the swirl. The noise signals will be generally identical and in phase where the source of the noise is located at a distance substantially greater than the spacing X such that the noise is received substantially at each microphone at substantially the same time.

The result of combining signals in this manner is an increased signal-to-noise ratio which enhances the monitoring ability of the system and its ability to discriminate between signal produced by the moving pattern and ambient noise. This ability is most directly realized with respect to low frequency noise, particularly that of 1 kHz and below, since the noise received by one of the two spaced sensors will be phase delayed and inverted due to the spacing of the microphones in relation to the wave length of the ambient sound. Spacing "X" of less than one-fourth of a wavelength of the sound signals is preferred. Signals from a properly moving swirl pattern may be, for example, 1.6 to 1.8 kHz. Signals caused by blocked air jets or other system problems tend to cause a frequency shift within the range from 500 Hz to 3.5 kHz. Microphones having diaphragms which are small with respect to the wavelength of the sound signals are preferred, as they are less directional and their positioning and orientation is less critical. Realistic Cat. No. 33-1063 microphones have performed acceptably for this purpose. Thus, a spacing X equal to approximately one inch or less based on the above frequency and wavelength has been found to be effective.

The illustrated variation of the two microphone embodiment of FIG. 5 is provided with a multiplier 41*d* to extract information to supplement that from the summing amplifier 41*c* of FIG. 5. With this variation, it has been found that multiplication of the two output signals from the amplifiers 41*a* and 41*b* produces a signal from the multiplier 41*d*, which has an average which is practically always positive when the signal-to-noise ratio is high. Further, the average of the product of the noise components of the outputs of the amplifiers 41*a* and 41*b* is almost always negative, at least where a signal is sound of a frequency below approximately 3 kHz. When the noise predominates, this negative component results in a change of the sign of the output of the multiplier 41*d*. Thus, the output from the multiplier 41*d* provides a highly reliable signal for analysis by providing an indication of whether other information extracted is due to the swirl (strong signal from the output of the multiplier 41*d*) or is caused by noise (a negative signal from the multiplier 41*d*).

Figure 5A:
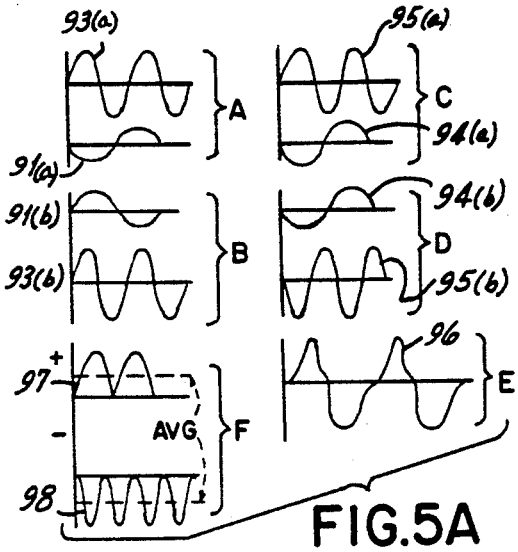
FIG. 5A is a diagram illustrating waveforms at points in the circuit of the embodiment of FIG. 5.

FIG. 5A illustrates waveforms at points in the circuit of the system of FIG. 5 showing the nozzle 22 with microphones 38*a* and 38*b* positioned facing each other opposite the swirl pattern in the plane behind the nozzle 22. Signals originating from the swirl pattern measured from diametrically opposite sides of the pattern are of opposite phase as shown by the respective signal component waveforms 91*a* and 91*b*, at points A and B on FIG. 5, from the respective microphones 38*a* and 38*b*. Background noise 92, will also be received by the microphones 38*a* and 38*b* in the same phase as represented by the noise component waveforms 93*a* and 93*b* at points A and B, respectively.

Both the swirl pattern signals and the noise signals are amplified by the amplifiers 41*a* and 41*b* respectively. Those signals passing through amplifier 41*a* remain of the same sign, as illustrated by the signal component waveform 94*a* and the noise component waveform 95*a* at point C in FIG. 5. Those signals passing through the amplifier 41*b* are inverted, as illustrated by the signal component waveform 94*b* and the noise component waveform 95*b* at point D in FIG. 5.

When the signals from the amplifiers 41*a* and 41*b* are summed, the result is a waveform 96 at point E in FIG. 5, which is approximately the sum of the pattern component of the signals 94*a* and 94*b* from the amplifiers 41*a* and 41*b*, but with some influence from the noise signals 95*a* and 95*b*, which may not perfectly cancel, to produce a frequency shift.

When the signals from the amplifiers are multiplied, the result at point F in FIG. 5, when the signal components 94*a* and 94*b* are the predominant components, is a waveform 97, having an average positive value. When the noise components 95*a* and 95*b* predominate, the result at point F in FIG. 5 is the waveform 98. Thus, a positive average signal 97 from the multiplier 41*d* indicates that a frequency shift of the signal from the summing amplifier 41*c* is probably the result of a change in the pattern characteristics. A negative average signal 98 from the multiplier 41*d* indicates that a frequency 41*c* is the probably the result of noise.

It has been found that, with the preferred embodiment of FIG. 5, detection of a change in frequency of the signal to the processor 60*a*, together with a detection of a decline in the amplitude of the signal, provides a highly reliable indication of a blocked air jet, a common operational malfunction of a controlled fiberization system. Furthermore, changes in frequency and amplitude of the output signal produced by ambient shop noise, it has been found, usually can be easily distinguished from those due to blocked nozzles and jets in which the output from the multiplier 41*d* to the processor 60*a* changes sign, or has its DC component move substantially to or near zero, as may be caused, for example, when a noise burst such as a horn or loud machine in the plant is picked-up by the microphones 38*a* and 38*b*.

Figure 6:
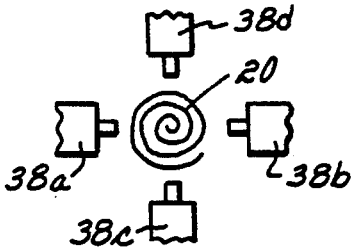
FIG. 6 is a top diagrammatic view through the swirl pattern showing a further variation of the embodiments of FIG. 5.

The embodiment of FIG. 6 contains the additional feature of a further pair of microphones 38*c* and 38*d*. These microphones are positioned at right angles to the microphones 38*a* and 38*b* to detect additional signals from the pattern 20, which are 90° and 270° respectively out of phase with the signal of transducer 38*a*. As such, the outputs of the microphones 38*c* and 38*d* may be combined as were the outputs of the microphones 38*a* and 38*b* as described in connection with FIG. 5 above. The information provided by the additional microphones further enhances the signal to noise ratio of the signal to the processor 60*a*.

The arrangement of FIG. 6 provides a capability for resolving the direction of pattern motion and the direction in which the pattern of fiber 20 may be skewed. This provides a powerful tool in the analysis of the signal by the processor 60*a*.

Thus, those skilled in the art will appreciate that variations of the above described embodiments may be made without departing from the principles of the present invention. Accordingly, it is intended only that the application be limited by the scope of the following claims:

I claim:

1. A method of monitoring the performance of a controlled fiberization device for dispensing a continuous fiber of liquid coating material distributed through a space between the dispensing device and a substrate in a continuous helical pattern which changes position with time by a rotating motion in the space, said method comprising the steps of:

sensing the rotating motion of the pattern of the material in the space between the dispensing device and the substrate; and generating in response to the sensed motion a signal representative of characteristics of the motion of the pattern in the space.

2. The method of claim 1 wherein the motion is sensed from a plurality of different angular positions around the pattern.

3. The method of claim 2 wherein:

the sensing step includes the step of positioning, at different angular positions about the pattern, a plurality of transducers and sensing therewith information of the motion of the pattern, including phase information related to the angular position of the pattern; and further comprising the step of combining the phase information from the plurality of transducers to resolve the angular characteristics of the pattern.

4. The method of claim 2 wherein the sensing step includes the step of:

positioning transducers adjacent the pattern, each transducer being capable of sensing information of the motion of the pattern.

5. The method of claim 1 wherein the sensing step includes the step of:

positioning adjacent the pattern at least two transducers and sensing therewith information of the rotating motion of the pattern; and the generating step includes generating with each transducer a signal in response to the information sensed by the transducer.

6. The method of claim 5 further comprising the steps of:

generating from said transducer signals a first output signal having an enhanced signal-to-noise ratio;

generating from said transducer signals a second output signal;

analyzing the output signals to discriminate between the information of the motion of the pattern and noise; and analyzing the output signals to determine the motion of the pattern.

7. The method of claim 5 further comprising the steps of:

inverting the signal from one said transducer and adding the inverted signal to the signal from the other transducer to produce an output signal.

8. The method of claim 7 further comprising the step of:

multiplying the inverted signal by the signal from the other transducer to generate a product signal; and correlating the product and output signals to discriminate between information of the motion of the pattern and noise.

9. The method of claim 1 wherein the sensed motion includes the sensing of a medium selected from the group consisting of: electromagnetic radiation, sound, and light modulated by the motion of the pattern in the space.

10. The method of claim 1 further comprising the steps of:

repeating said sensing step;

performing a measurement of a characteristic of the signal generated in each generating step;

comparing the measurement so performed; and producing an output in response to the measurement comparing step.

11. A method of controlling the dispensing of a continuous fiber of liquid coating material distributed in a space between a dispensing device and a substrate to form a pattern in the space, said method comprising the steps of;

ejecting liquid coating material from a dispensing device toward a substrate in a continuous fiber extending through a space located between the dispensing device and the substrate while causing the fiber to change position in the space with time;

sensing motion of the pattern due to the time changing position of the fiber of the material in the space between the dispensing device and the substrate;

generating in response to the information a signal representative of characteristics of the motion of the pattern in the space; and controlling the ejection in response to said signal.

12. The method of claim 11 further comprising the steps of:

performing a measurement of at least one of the characteristics when the system is operating under conditions to be monitored; and comparing the measurement with stored reference characteristics; and the signal generating step includes the step of generating the signal in response to the comparing step.

13. The method of claim 12 wherein:

the measurement performing step includes the step of generating a frequency spectrum of the signal; and the characteristic includes at least one characteristic selected from the group consisting of: primary frequency mode of the signal, harmonics thereof, and amplitude of the primary mode of the signal.

14. The method of claim 12 wherein the material is ejected from the dispensing device and subjected to streams of air emitted from jets, and wherein:

the stored reference characteristics include characteristics stored by performing a measurement of at least one of the characteristics when the system is operating with at least one of the jets obstructed.

15. The method of claim 11 wherein the coating material is dispensed under pressure from the dispensing device, and wherein the controlling step comprises the steps of:

comparing the signal representative of the characteristics of the motion of the pattern with stored reference characteristics; and varying the pressure of the material ejected from the dispensing device in response to said comparison.

16. The method of claim 11 wherein the dispensed coating material is subjected to streams of air emitted under pressure from jets, and wherein the controlling step comprises the steps of:

comparing the signal representative of the characteristics of the motion of the pattern with stored reference characteristics; and varying the pressure of the air emitted from the jets.

17. The method of claim 11 wherein:

the controlling step includes the step of stopping a function of the dispensing device.

18. The method of claim 11 wherein the sensing step includes the step of sensing energy selected from the group consisting of electromagnetic radiation, sound, and light modulated by the motion of the pattern in the space.

19. The method of claim 11 further comprising the steps of:

performing a measurement of at least one of the characteristics when the system is operating under conditions to be monitored;

comparing the measurement with reference characteristics; and the signal generating step includes the step of generating the signal in response to the comparing step.

20. The method of claim 11 further comprising the steps of:

repeating said sensing and generating steps;

performing a measurement of a characteristic of the signal generated in each generating step;

comparing the measurements; and producing an output in response to the comparison.

21. A method of dispensing liquid coating material onto a substrate that moves past the dispensing device at a speed which may vary, said method comprising the steps of:

ejecting coating material at a controlled rate from a dispensing device toward a substrate through a space located between the dispensing device and the substrate, the ejected material being distributed in the space so as to form a pattern in the space which moves such that the distribution of material in the space changes position therein as a function of time;

sensing the time changing position of the pattern of the material in the space between the dispensing device and the substrate and generating a feedback signal responsive to the sensed change of position of the pattern;

generating a speed signal in response to the speed of the substrate past the dispensing device; and, varying the rate at which the coating material is ejected from the dispensing device in response to the speed signal and feedback signal so as to vary the rate at which the material is ejected in relation to the speed of the substrate past the dispensing device.

22. The method of claim 21 wherein:

the sensing step includes the steps of sensing information correlated to the time varying change of position of the pattern of material in the space between the dispensing device and the substrate, and generating the feedback signal from the information;

generating a reference signal in response to the speed signal;

comparing the feedback signal with the reference signal; and varying said rate of ejection in response to the comparison.

23. The method of claim 22 wherein:

the sensing step includes the step of sensing sound produced by the motion of the pattern and the information correlated to the motion of the pattern is the frequency of the sound.

24. A method of monitoring the performance of a dispensing device for dispensing a coating material in a flowable state through a space between the dispensing device and a substrate in a distribution that forms a continuous rotating pattern in the space that changes position in the space with time so as to modulate energy propagating in the space with information of the time varying change in the position of the distribution of material in the space, said method comprising the steps of:

sensing the information of the time varying change of the position of the rotating pattern of the material from the propagating energy in the space between the dispensing device and the substrate; and generating in response to the information a signal representative of characteristics of the changing position of the rotating pattern in the space.

25. A method according to claim 24 further comprising the steps of:

ejecting coating material from a nozzle toward a substrate through a space located between the nozzle and the substrate along a path that changes position with time; and controlling the ejection in response to said signal.

26. The method of claim 24 wherein the energy is selected from the group consisting of electromagnetic radiation, sound, and light modulated by the motion of the pattern that changes position as a function of time in the space.

27. A method of monitoring the performance of a dispensing device for dispensing a coating material in a flowable state through a space between the dispensing device and a substrate in a distribution that forms a continuous rotating pattern in the space that changes position in the space with time so as to modulate energy propagating in the space with information of the time varying change in the position of the distribution of material in the space, said method comprising the steps of:

sensing the information of the time varying change of the position of the rotating pattern of the material from the propagating energy in the space between the dispensing device and the substrate;

generating in response to the information a signal representative of characteristics of the changing position of the rotating pattern in the space;

dispensing coating material onto the substrate, where the substrate moves past the dispensing device at a speed which may vary, wherein:

the ejecting of coating material is at a controlled rate from the dispensing device toward a substrate through a space located between the dispensing device and the substrate so as to cause the material to form a moving rotating pattern as it moves along a path that changes position as a function of time; and the method further comprises the steps of sensing the rotating motion of the pattern of the material in the space between the dispensing device and the substrate and generating a feedback signal responsive to the sensed change of position of the pattern, generating a speed signal in response to the speed of the substrate past the dispensing device, and, varying the rate at which the coating material is ejected from the dispensing device in response to the speed signal and feedback signal so as to vary the rate at which the material is ejected in relation to the speed of the substrate past the dispensing device.

28. A method of monitoring the performance of a dispensing device for dispensing a coating material in a flowable state through a space between the dispensing device and a substrate in a distribution that forms a continuous rotating pattern in the space that changes position in the space with time so as to modulate energy propagating in the space with information of the time varying change in the position of the distribution of material in the space, said method comprising the steps of:

sensing the information of the time varying change of the position of the rotating pattern of the material from the propagating energy in the space between the dispensing device and the substrate;

generating in response to the information a signal representative of characteristics of the changing position of the rotating pattern in the space;

the coating material being dispensed under pressure from the dispensing device, and the controlling step comprising the steps of:

comparing the signal representative of the characteristics of the rotating motion of the pattern with stored reference characteristics; and the controlling step includes the step of varying the pressure of the material ejected from the dispensing device in response to said comparing step.

29. A method of monitoring the performance of a dispensing device for dispensing a coating material in a flowable state through a space between the dispensing device and a substrate in a distribution that forms a continuous rotating pattern in the space that changes position in the space with time so as to modulate energy propagating in the space with information of the time varying change in the position of the distribution of material in the space, said method comprising the steps of:

sensing the information of the time varying change of the position of the rotating pattern of the material from the propagating energy in the space between the dispensing device and the substrate;

generating in response to the information a signal representative of characteristics of the changing position of the rotating pattern in the space;

the dispensed coating material being subjected to streams of air emitted under pressure from jets; and the controlling step including the step of comparing a signal representative of the characteristics of the motion of the rotating pattern with stored criteria and, in response the comparing step, varying the pressure of the air emitted from the jets.

30. A method of monitoring the performance of a dispensing device for dispensing a coating material in a flowable state through a space between the dispensing device and a substrate in a distribution that forms a continuous rotating pattern in the space that changes position in the space with time so as to modulate energy propagating in the space with information of the time varying change in the position of the distribution of material in the space, said method comprising the steps of:

sensing the information of the time varying change of the position of the rotating pattern of the material from the propagating energy in the space between the dispensing device and the substrate;

generating in response to the information a signal representative of characteristics of the changing position of the rotating pattern in the space; and the information being sensed from a plurality of different angular positions around the pattern.

31. The method of claim 30 wherein:

the sensing step includes the step of positioning, at different angular positions about the pattern, a plurality of transducers and sensing therewith the propagating energy;

the information of the motion of the pattern includes phase information related to the angular position of the pattern; and the method further comprises the step of combining the phase information from the plurality of transducers so as to resolve the angular characteristics of the pattern; and the generating step includes the step of generating the signal representative of characteristics of the changing position of the pattern in the space in response to the combined phase information.

* * * * *